US008640453B2

(12) United States Patent
Takeuchi

(10) Patent No.: US 8,640,453 B2
(45) Date of Patent: Feb. 4, 2014

(54) HEAT ENGINE

(75) Inventor: Makoto Takeuchi, Tokyo (JP)

(73) Assignee: Alpha Plus Power Inc., Tokyo (JP)

( * ) Notice: Subject to any disclaimer, the term of this patent is extended or adjusted under 35 U.S.C. 154(b) by 654 days.

(21) Appl. No.: 12/821,859

(22) Filed: Jun. 23, 2010

(65) Prior Publication Data

US 2011/0252780 A1 Oct. 20, 2011

(30) Foreign Application Priority Data

Apr. 20, 2010 (JP) ..... 2010-097201
May 6, 2010 (KR) ..... 10-2010-0042388

(51) Int. Cl.
*F01B 29/08* (2006.01)
*F01K 25/00* (2006.01)
*F01B 29/10* (2006.01)
*F02G 1/04* (2006.01)

(52) U.S. Cl.
USPC ..... 60/516; 60/517; 60/518

(58) Field of Classification Search
USPC ..... 60/516–525; 62/6, 520; 92/31, 33, 92/72–74
See application file for complete search history.

(56) References Cited

U.S. PATENT DOCUMENTS 3,937,018 A * 2/1976 Beale ..... 60/520
5,335,506 A * 8/1994 Byoung-Moo ..... 62/6
7,836,691 B2 * 11/2010 Takeuchi ..... 60/517

FOREIGN PATENT DOCUMENTS

EP 1820953 A1 * 8/2007
JP 2006-118430 A 5/2006

OTHER PUBLICATIONS

Takeuchi, M., et al., "Design of a+-type Stirling Engine in higher buffer pressure and higher engine speed", proceedings of the 12th Symposium on Stirling Cycle, No. 09-50, pp. 13-16, (Nov. 6, 2009).

* cited by examiner

*Primary Examiner* — Thomas Denion
*Assistant Examiner* — Brian Inacay
(74) *Attorney, Agent, or Firm* — Nath, Goldberg & Meyer; Jerald L. Meyer

(57) ABSTRACT

A heat engine includes: a high-temperature space portion and a low-temperature space portion, each of which has a working gas with a different temperature range from each other; a regenerator provided between both of the space portions; a first piston configured to cause volumetric changes of the working gases in the space portions and transmit motive energy on receipt of pressure changes of the working gases; and a second piston and a third piston configured to transfer the working gases between both of the space portions and move with a 180° phase difference from each other with respect to the regenerator. The second piston is slidably housed in a cylinder portion included in the first piston. Heat and motive energy are exchanged by using the volumetric changes in both of the space portions, as well as by using the transfer of the working gases.

4 Claims, 8 Drawing Sheets

HEAT ENGINE

CROSS REFERENCE TO RELATED APPLICATION

This application is based upon and claims the benefit of priority from the prior Japanese Patent Application No. 2010-97201, filed on Apr. 20, 2010 and the prior Korean Patent Application No. 10-2010-0042388, filed on May 6, 2010, the entire contents of which are incorporated herein by reference.

BACKGROUND OF THE INVENTION

1. Field of the Invention

The present invention relates to a heat engine in which spaces that retain working gases with different temperature ranges from each other are provided, and a regenerator is provided as a boundary between the temperature ranges. In such a heat engine, heat and motive energy are exchanged by using volumetric changes of a high-temperature space and of a low-temperature space, which are located on either side of the regenerator, and by using a transfer of working gases between the spaces.

2. Description of the Related Art

A Stirling Cycle is characterized by its capability of running on not only a combustion heat source but also other heat sources with various temperature differences, such as waste heat and solar heat. Obtaining maximum output from heat sources with various temperature ranges requires an optimization of balance between the volumetric change of working gas and gas flow passing through a regenerator in accordance with the temperature difference.

Specifically, use of a heat source with a smaller temperature difference, such as waste heat and solar heat, needs a larger ratio of gas flow passing through the regenerator compared to the volumetric change. The reason is as follows. A source of output of the Stirling Cycle in this case is a rise in gas pressure at the time when the gas passes through the regenerator. A smaller temperature difference renders a smaller rise in pressure relative to the gas flow passing therethrough. Accordingly, obtaining maximum output from a heat source with a smaller temperature difference needs an increase in gas flow passing through the regenerator relative to the volumetric change in comparison to gas flow in a case of using a heat source with a larger temperature difference.

SUMMARY OF THE INVENTION

Especially, the Stirling Cycle running on a heat source with a smaller temperature difference needs an increase in gas flow passing through the regenerator relative to the volumetric change in comparison to gas flow in a case of using a heat source with a larger temperature difference.

It is an object of the present invention to provide a heat engine capable of obtaining a sufficient pressure change by increasing gas flow passing though the regenerator when using a heat source with a smaller temperature difference.

An aspect of the present invention is a heat engine comprising: a high-temperature space portion and a low-temperature space portion, each of which has a working gas with a different temperature range from each other; a regenerator provided between the high-temperature space portion and the low-temperature space portion; a first piston including a cylinder portion in the first piston, the first piston configured to cause volumetric changes of the working gases in each of the high-temperature space portion and the low-temperature space portion and transmit motive energy on receipt of pressure changes of the working gases; and a second piston and a third piston provided in the high-temperature space portion and the low-temperature space portion, respectively, the second piston and the third piston configured to transfer the working gases between the high-temperature space portion and the low-temperature space portion and move with a 180° phase difference from each other with respect to the regenerator, wherein the second piston is slidably housed in the cylinder portion of the first piston, the first piston, and the second piston and the third piston are configured to move with a phase difference smaller than 180°, and heat and motive energy are exchanged by using the volumetric changes in the high-temperature space portion and the low-temperature space portion located respectively on both sides of the regenerator, as well as by using the transfer of the working gases.

The second piston and the third piston may be connected to each other with a connecting rod.

The second piston and the third piston may be connected to each other in each center portion with a single connecting rod.

A diameter of the first piston may be larger than a diameter of the third piston.

Heat engine units, each of which includes the first to third pistons, may be stacked in a moving direction of the first to third pistons; and one piston between the heat engine units stacked and located adjacent to each other may be shared by each of the heat engine units as the third piston.

According to the above-mentioned configuration, the working spaces that retain the working gases with different temperature ranges from each other are provided. Each of the spaces is provided with a power piston to cause the volumetric change of the working gas and transmitting motive energy on receipt of the pressure change of the working gas, and provided with displacers to transfer the working gases between the high-temperature space and the low-temperature space. Accordingly, it is possible to obtain necessary gas flow passing through the regenerator in accordance with the temperature difference, and obtain a sufficient pressure change.

Moreover, the two pistons are positioned opposite each other, so as to constitute the displacers. Therefore, the pistons can move with a phase difference of 180° to each other with respect to the regenerator by connecting the two pistons to each other by the connecting rod. Accordingly, the pressure changes of the working gases can be absorbed with the connecting rod even if the pistons to be used have large areas, and a piston force acting on a crankshaft can be maintained to be small. As a result, it is possible to achieve a smaller radius of the crankshaft and minimize a mechanical loss.

DETAILED DESCRIPTION OF THE EMBODIMENT

Figure 1:
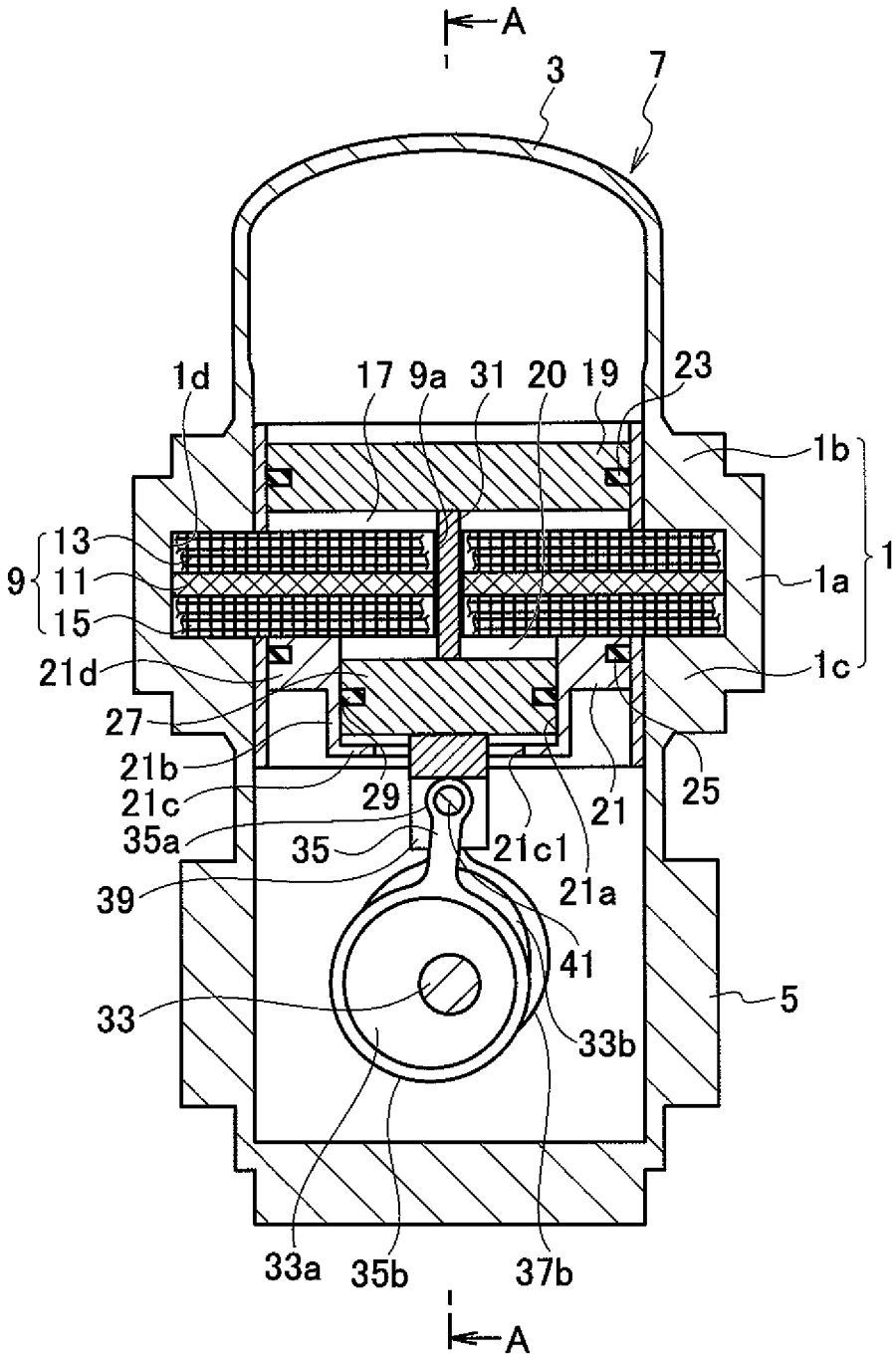
FIG. 1 is a cross-sectional view as seen from an axis direction of a crankshaft of a heat engine according to a first embodiment of the present invention.

A description will be made below of embodiments of the present invention with reference to the drawings. Note that, the similar elements are included in the following embodiments and modified examples. In the following description, the similar elements are designated by the same reference numerals, and the common explanations thereof will not be repeated accordingly.

First Embodiment

Figure 2:
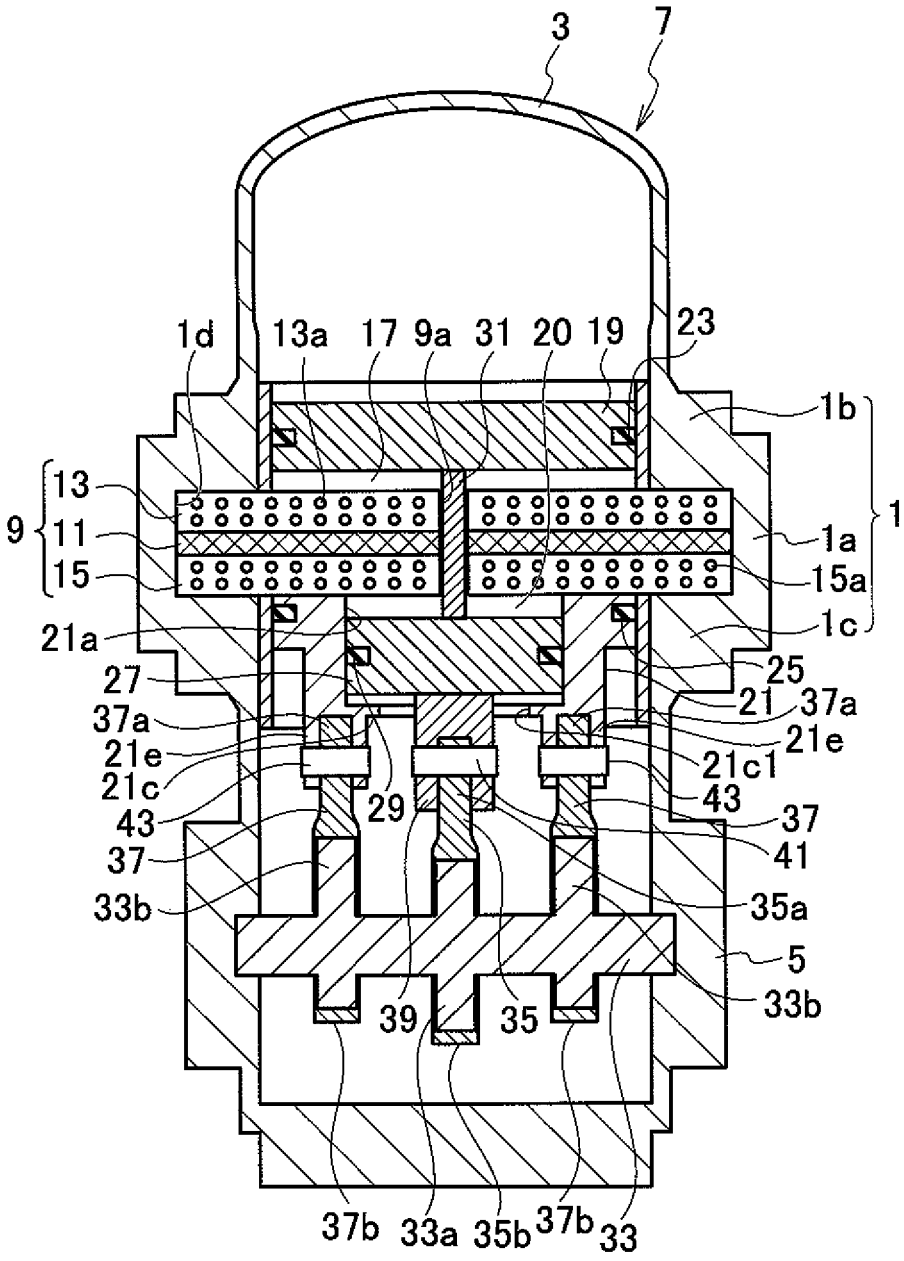
FIG. 2 is a cross-sectional view along a line A-A of FIG. 1.

FIGS. 1 and 2 show a Stirling engine as a heat engine including a Stirling Cycle according to the first embodiment of the present invention. A housing main body 1, a cover 3 attached to an upper opening of the housing main body 1, and a crankcase 5 attached to a lower opening of the housing main body 1 constitute a housing 7.

Note that, for ease of reference in each figure using for the following explanation, including the above-mentioned FIGS. 1 and 2, the housing main body 1, the cover 3 and the crankcase 5 are shown as an integrated member.

A heat-exchanger unit 9 is housed in and fixed to a heat-exchanger housing portion 1*a*, which is shown approximately at the center of the housing main body 1 in a vertical direction in the figure. A regenerator 11 as a boundary between temperature ranges that are different from each other is provided to the center of the heat-exchanger unit 9, while a heat sink 13 and a radiator 15 are respectively provided above and below the regenerator 11.

The heat sink 13 includes heat transfer pipes 13*a* extending in a direction, in FIG. 2, orthogonal to the paper surface on which the figure is drawn. High-temperature fluid flows in the heat transfer pipes 13*a* through an outer portion of the heat-exchanger housing portion 1*a*, and a plurality of fins are attached around the heat transfer pipes 13*a*. Likewise, the radiator 15 includes heat transfer pipes 15*a* extending in a direction, in FIG. 2, orthogonal to the paper surface on which the figure is drawn. Low-temperature fluid flows in the heat transfer pipes 15*a* through an outer portion of the heat-exchanger housing portion 1*a*, and a plurality of fins are attached around the heat transfer pipes 15*a*. Meanwhile, the regenerator 11 is configured as a stack metal wire mesh, and the like.

The housing main body 1 on an upper side of the heat sink 13 in the figure is provided with a high-temperature side cylinder portion 1*b*, in which a first displacer 19 (a third piston) is housed slidably in a vertical direction in the figure in a high-temperature space 17 of the high-temperature side cylinder portion 1*b*. While, the housing main body 1 on a lower side of the radiator 15 in the figure is provided with a low-temperature side cylinder portion 1*c*, in which a power piston 21 (a first piston) is housed slidably in a vertical direction in the figure in a low-temperature space 20 of the low-temperature side cylinder portion 1*c*. Piston rings 23 and 25 are attached to peripheries of the first displacer 19 and the power piston 21, respectively.

The above-described first displacer 19 and power piston 21 have an equal outside diameter. The heat-exchanger unit 9 positioned between the first displacer 19 and the power piston 21 has a larger outside diameter than the first displacer 19 and the power piston 21 so as to protrude outward in a radial direction more than peripheral surfaces of the first displacer 19 and the power piston 21. The heat-exchanger unit 9 has a substantial square shape in a plan view (viewing in a vertical direction in FIGS. 1 and 2). In this case, a peripheral edge of the heat-exchanger unit 9 is inserted and positioned in a convex portion 1*d* formed in a portion corresponding to the heat-exchanger housing portion 1*a* of the housing main body 1.

A cylinder portion 21*a* is formed as a piston housing in the power piston 21 at a side facing the heat-exchanger unit 9. A second displacer 27 (a second piston), which has a smaller outside diameter than the first displacer 19, is housed slidably in a vertical direction in the figure in the cylinder portion 21*a*. A piston ring 29 is attached to a periphery of the second displacer 27.

The first displacer 19 and the second displacer 27 are connected to each other with a connecting rod 31, which is inserted slidably in an axis direction (a vertical direction) in a through hole 9*a* penetrating the center of the heat-exchanger unit 9. The second displacer 27 is connected to a crankshaft 33 rotatably housed inside the crankcase 5 via a single connecting rod 35.

When one of the first displacer 19 and the second displacer 27 is at top dead center, the other is at bottom dead center. That means two pistons that move with a 180° phase difference from each other with respect to the heat-exchanger unit 9 constitute the first displacer 19 and the second displacer 27.

Meanwhile, the power piston 21 is connected to the crankshaft 33 via two connecting rods 37 so as to move with a phase difference smaller than 180°, such as a 90° phase difference, with respect to the first displacer 19.

The power piston 21 provided with the cylinder portion 21*a* therein includes a cylindrical peripheral wall portion 21*b*, a disk-shaped bottom wall portion 21*c*, and a piston top portion 21*d* facing the heat-exchanger unit 9 and located at an opposite side to the bottom wall portion 21*c* with regard to the peripheral wall portion 21*b*.

A connecting member 39 attached to the center of a bottom surface of the second displacer 27 is inserted slidably in a vertical direction in the figure in a through hole 21*c*1 provided in the center of the bottom wall portion 21*c*. Moreover, a small end portion 35*a* of the connecting rod 35 is rotatably attached to a piston pin 41 provided to the connecting member 39.

In addition, as shown in FIG. 2, boss portions 21*e* are formed so as to protrude toward the crankshaft 33 in a periphery of the bottom wall portion 21*c* of the power piston 21. Moreover, small end portions 37*a* of the connecting rods 37 are rotatably attached to piston pins 43 provided to the boss portions 21*e*.

Large end portions 35*b* and 37*b* provided in the respective connecting rod 35 and two connecting rods 37 are formed in a circular shape. Eccentric disk portions 33*a* and 33*b* formed eccentrically with respect to the crankshaft 33 are rotatably attached to the circular large end portions 35*b* and 37*b*.

As described above, due to a rotation of the crankshaft 33, the first and second displacers 19 and 27 move with a 180° phase difference from each other via the single connecting rod 35. At the same time, the power piston 21 moves with a phase difference smaller than 180°, such as a 90° phase difference, with respect to the first displacer 19.

Further, the high-temperature space 17 is formed between the heat sink 13 and the first displacer 19, in which working gas heated by the heat sink 13 is expanded. The low-temperature space 20 is formed between the radiator 15, and the second displacer 27 and the power piston 21, in which working gas that has lost its heat at the radiator 15 is compressed. Heat and motive energy are exchanged by transferring the working gases between the high-temperature space 17 and the low-temperature space 20, and then by repeating expansion and compression of the working gases.

Thus, the regions surrounded by the housing main body 1 and the respective the first displacer 19 and the power piston 21 are working gas spaces in each of which a working gas, such as a Helium gas, is filled, and each of which is sealed. In this case, the power piston 21 causes a volumetric change of the working gas in the low-temperature space 20. The power piston 21 has a function to transmit motive energy by receiving a pressure change of the working gas. While, the first and second displacers 19 and 27 have a function to transfer the working gases between the high-temperature space 17 and the low-temperature space 20.

The first and second displacers 19 and 27 have different outside diameters, respectively. Therefore, the first and second displacers 19 and 27 function not only as a displacer but also as a power piston that causes a volumetric change.

When a reciprocating movement of the power piston 21, which is produced by changes in pressure of the working gas, is taken out as a rotating movement by the crankshaft 33, the Sterling Cycle functions as an engine. In contrast, when the crankshaft 33 is made to rotate by external driving means, such as a motor, and thus when the power piston 21 is made to move reciprocally, the Sterling Cycle functions as a heat pump or a refrigerator, which supplies a high-temperature heat or a low-temperature heat to the outside via heat transfer fluid that flows in the heat transfer pipes 13*a* or 15*a* penetrating the heat sink 13 or the radiator 15.

In the Sterling Cycle according to the above-described first embodiment, when the first displacer 19 and the second displacer 27 reciprocally travel with a 180° phase difference with respect to the heat-exchanger unit 9, the power piston 21 reciprocally travels to cause the volumetric change in the working gas space. As a result, the above operation in the high-temperature space 17 and the low-temperature space 20 is made substantially equivalent to an operation with a phase difference other than that of 180°.

The volumetric changes in the working gas spaces bring about the expansion and compression of the working gases, by which heat and motive energy are exchanged. Specifically, the working gases consecutively pass through the heat sink 13, regenerator 11 and then the radiator 15 as a reciprocating flow. At this time, the working gases are subjected to a heat exchange in the heat sink 13 and in the radiator 15, and the working gases transfer through the regenerator 11.

In the present embodiment, the power piston 21 that causes a volumetric change in the working gas and transmits motive energy by receiving a pressure change in the working gas is provided, and the first and second displacers 19 and 27 that transfer the working gases between the high-temperature space 17 and the low-temperature space 20 are provided, with respect to the working gas spaces that retain the working gases with different temperature ranges from each other. Accordingly, it is possible to obtain necessary gas flow passing through the regenerator in accordance with the temperature difference, and obtain a sufficient pressure change.

Accordingly, suppose that the high-temperature space 17 and the low-temperature space 20 are operated substantially with a phase difference other than that of 180°, for example, with an approximately 150° phase difference. In this case, since a stroke volume of the power piston 21 is smaller than those of the displacers 19 and 27, the phase difference between the volumetric changes of the high-temperature space 17 and the low-temperature space 20 can be made substantially large. For this reason, the power piston 21 may be connected to the crankshaft 33 so that the power piston 21 and the first displacer 19 may have a 90° phase difference. As a result, the setting of the crankshaft 33 is easy, and the maximum output can be easily obtained even for a small-temperature-difference type Sterling Cycle, theoretically as in the case of a crankshaft for a high-temperature-difference type Sterling Cycle.

Additionally, in this case, even when the heat-exchanger unit 9 is made to be thinner and to have a larger surface area, that is, the heat-exchanger unit 9 is made to be more compact, a high-speed revolution is achieved easily. Since the first displacer 19 and the second displacer 27 are configured to have a 180° phase difference from each other with respect to the heat-exchanger unit 9, that is, the displacers 19 and 27 travel together as a single unit, the working gases transfer between the high-temperature space 17 and the low-temperature space 20 with certainty. In addition, a resistance of flow passage and pressure loss are reduced. Since the high-speed revolution is achieved, and the Stirling Cycle is made to be compact, the Stirling Cycle is optimized for a low-temperature-difference type Stirling engine, which can effectively utilize a natural energy, such as geothermal heat, as well as industrial waste heat.

In the Sterling Cycle according to the above-described first embodiment, the piston top portion 21*d* of the power piston 21 has a smaller pressure receiving area than a pressure receiving area of the first displacer 19 by providing the cylinder portion 21*a* inside the power piston 21. In such a case, the two connecting rods 37 are connected to the two portions in the periphery of the power piston 21 to support the power piston 21 as a supporting structure. As a result, it is possible to support the power piston 21 more reliably while preventing the configuration from being complicated even when the pressure receiving area is small.

Moreover, in the present embodiment, the first and second displacers 19 and 27 constituted with two pistons are connected to each other with the connecting rod 31. Thus, a piston force acting on the first displacer 19 and the second displacer 27 is absorbed by the connecting rod 31, and only a difference force due to an area difference between the displacers 19 and 27 acts on the crankshaft 33. Accordingly, a mechanical loss is reduced, and a high-speed revolution is achieved easily.

Moreover, in the present embodiment, the first and second displacers 19 and 27 constituted with two pistons are connected to each other in each center portion with the single connecting rod 31. In this case, the first displacer 19 at an expansion side has a higher temperature (300° C., for example) than the second displacer 27 at a compression side. As a result, a difference in thermal expansion is caused between the first and second displacers 19 and 27.

However, the center portions of the respective first and second displacers 19 and 27 are connected to each other with the single connecting rod 31. Therefore, a possibility of an inclination of the connecting rod 31, and a mutual interference and an increase in sliding resistance between members such as the connecting rod 31 and the through hole 9*a* of the heat-exchanger unit 9 can be prevented. Accordingly, it is possible to manufacture the through hole 9*a* to fit the connecting rod 31 with a small clearance between the through hole 9*a* and the connecting rod 31, thereby reducing leakage of the working gas and increasing efficiency.

In addition, only the single connecting rod 31 is used for such a connection, which results in reduction of assembly error and in improvement in assembly workability. Moreover, the number of members to be used is reduced and a requirement for processing accuracy is decreased, which results in cost reduction.

Figure 8:
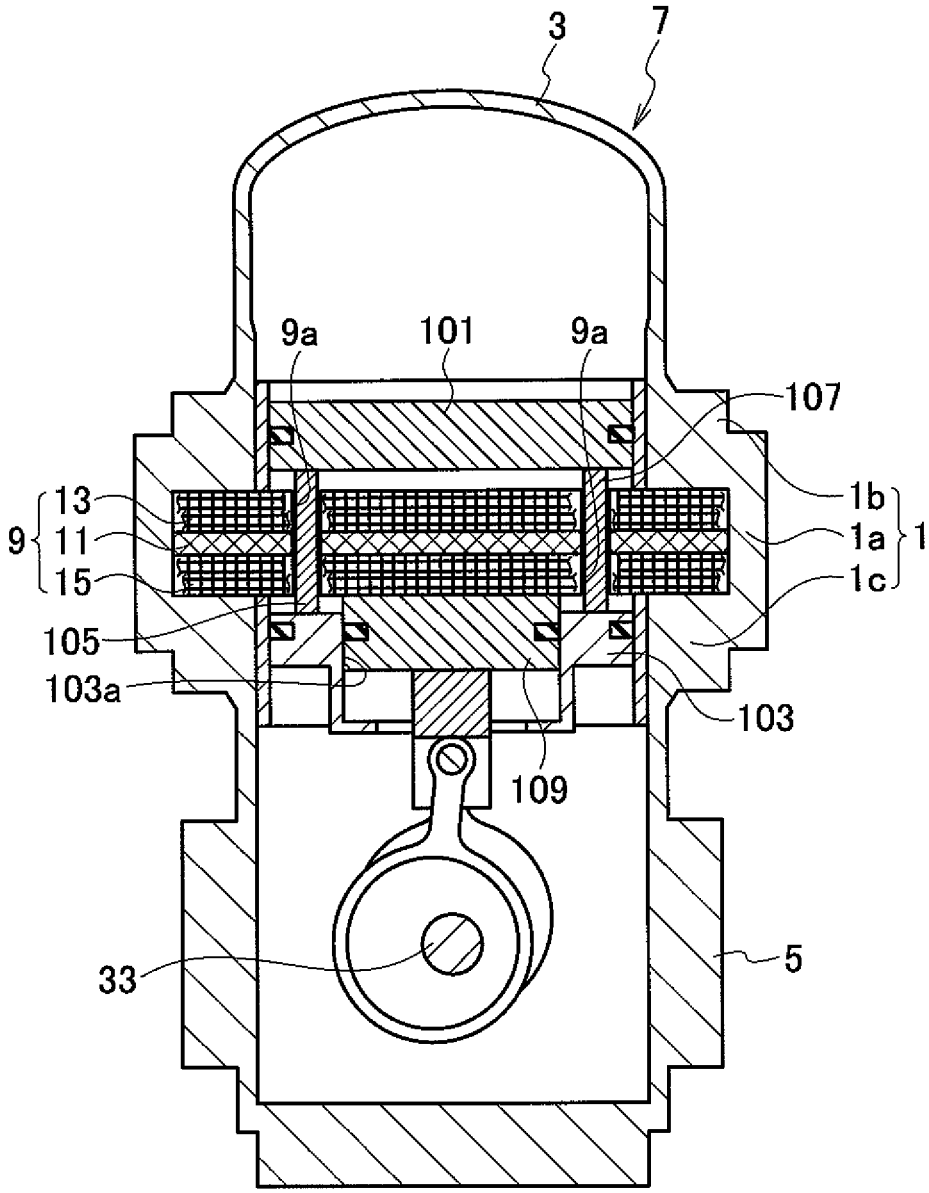
FIG. 8 is a cross-sectional view corresponding to FIG. 1 with regard to a heat engine according to a reference example.

Meanwhile, in a heat engine of a reference example shown in FIG. 8, for example, two displacers 101 and 103 are connected to each other with two connecting rods 105 and 107. In this case, a power piston 109 is housed in a cylinder portion 103*a* formed in one displacer 103.

In such a configuration in which the two displacers 101 and 103 are connected to each other with the two connecting rods 105 and 107, the connecting rods 105 and 107 may be inclined due to an uneven interval between the connecting rods 105 and 107 caused by a difference in thermal expansion between the two displacers 101 and 103. As a result, a mutual interference and an increase in sliding resistance between members such as the connecting rods 105 and 107 and the through holes 9*a* of the heat-exchanger unit 9 may be caused.

Second Embodiment

Figure 3:
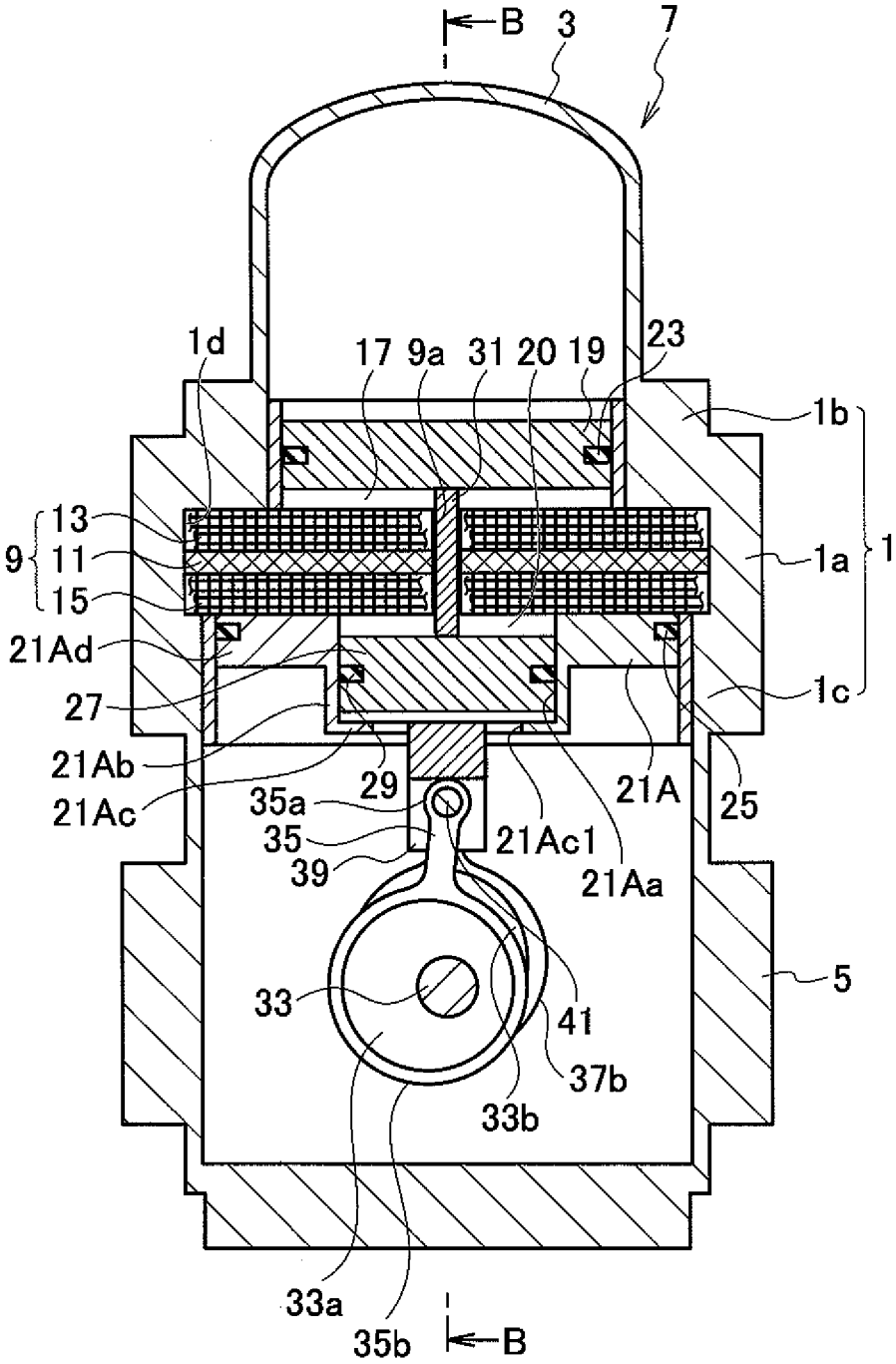
FIG. 3 is a cross-sectional view as seen from an axis direction of a crankshaft of a heat engine according to a second embodiment of the present invention.
Figure 4:
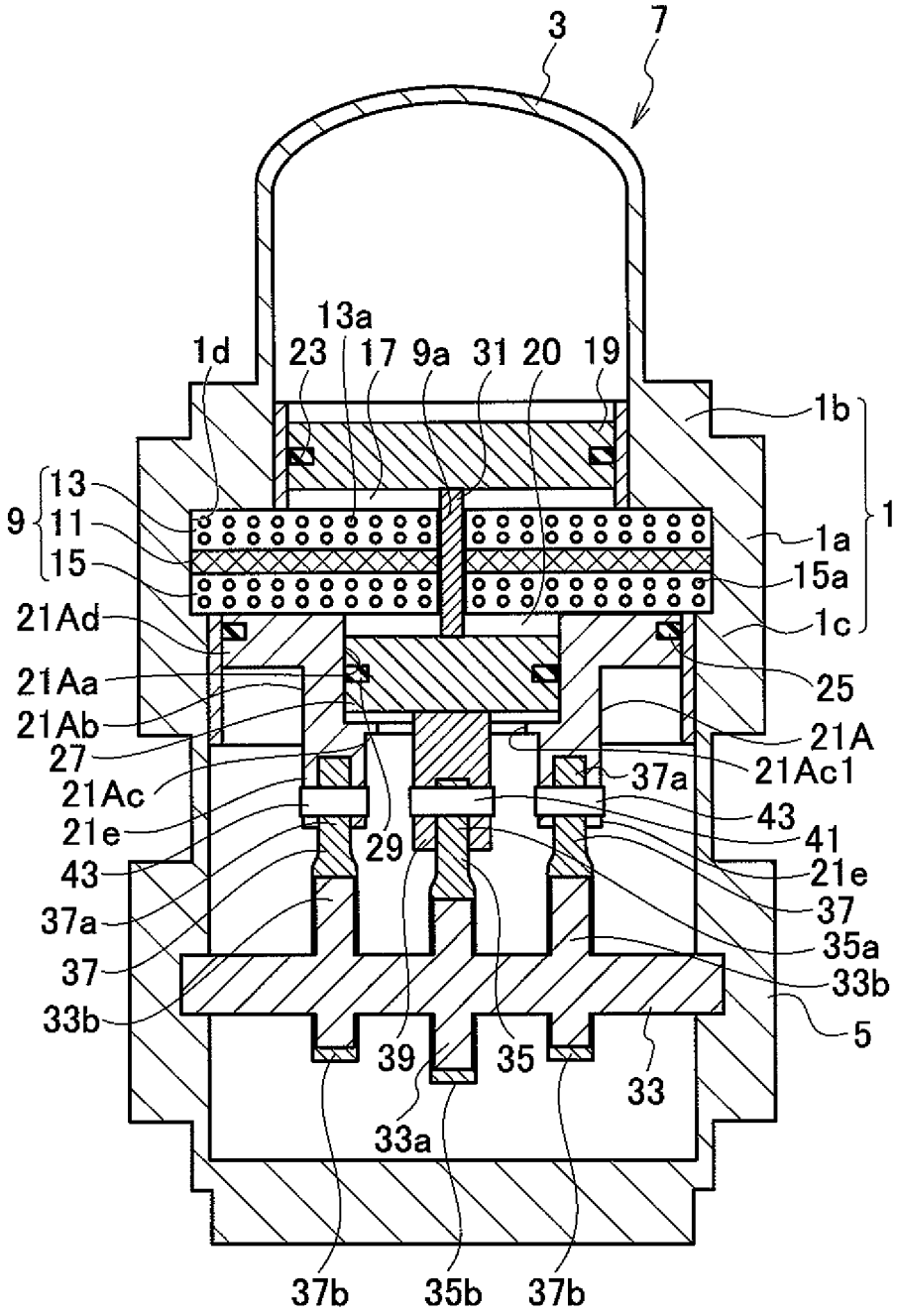
FIG. 4 is a cross-sectional view along a line B-B of FIG. 3.

In the second embodiment as shown in FIGS. 3 and 4, an outside diameter of a power piston 21A corresponding to the power piston 21 in FIG. 1 described above is larger than that of the power piston 21 in FIG. 1, which means that the outside diameter of the power piston 21A is larger than that of the first displacer 19. Thus, a diameter of the cylinder portion 1*c* at a low-temperature side of the housing main body 1 housing the power piston 21A is larger than that in FIG. 1. Accordingly, a size of the crankcase 5 is increased with an enlargement of the diameter of the cylinder portion 1*c*.

Note that, in the second embodiment, the outside diameter of the first displacer 19 may be reduced with respect to that of the power piston 21 while maintaining the outside diameter of the power piston 21 in the configuration of FIG. 1.

The other constitutions are similar to those of the first embodiment, and the similar elements to the first embodiment are designated by the common reference numerals. Note that, with regard to each component in the power piston 21A, a symbol "A" is added to each reference numeral.

While the power piston 21 is connected to the crankshaft 33 with the two connecting rods 37, the first displacer 19 is connected to the crankshaft 33 with the one connecting rod 35. When the power piston 21 and the first displacer 19 have the same outside diameter, a piston force acting on the power piston 21 and the first displacer 19 is equivalent. As a result, a load of a drive system of the first and second displacers 19 and 27 is twice as much as that of a drive system of the power piston 21.

In the present embodiment, on the other hand, a piston force applied to the power piston 21A can be relatively increased by making the outside diameter of the power piston 21A larger than that of the first displacer 19. Accordingly, the piston force acting on the first and second displacers 19 and 27 can be reduced.

When a formula: an area of the power piston=C×(an area of the first displacer−an area of the second displacer) and a formula: C=support points of the power piston/support points of the displacer are assumed, loads of each support point can be equivalent.

Therefore, the piston force acting on the first and second displacers 19 and 27 and the piston force acting on the power piston 21A can be balanced more fairly. Thus, the force acting on the single connecting rod 35 can be further reduced.

Specifically, the outside diameter of the power piston 21A is larger than that of the first displacer 19, and an outside diameter of the second displacer 27 is smaller than that of the first displacer 19, as shown in FIG. 3. Accordingly, the piston force acting on the first and second displacers 19 and 27 and the piston force acting on the power piston 21A can be balanced much more fairly.

Furthermore, in the second embodiment, when the second displacer 27 has the same outside diameter as that of the first displacer 19 by making the outside diameter of the second displacer 27 larger, the first and second displacers 19 and 27 only function as a displacer, whereby the piston force can only act on the power piston 21A.

Third Embodiment

Figure 5:
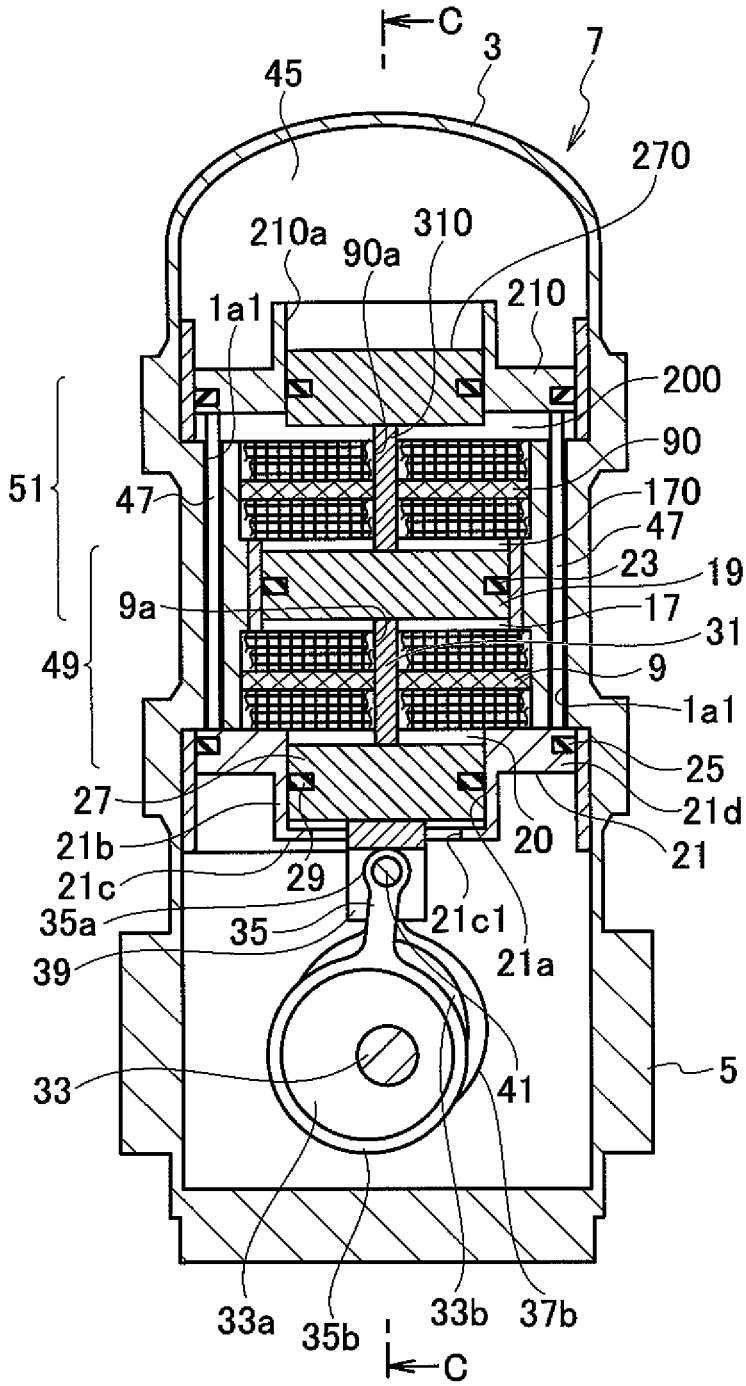
FIG. 5 is a cross-sectional view as seen from an axis direction of a crankshaft of a heat engine according to a third embodiment of the present invention.
Figure 6:
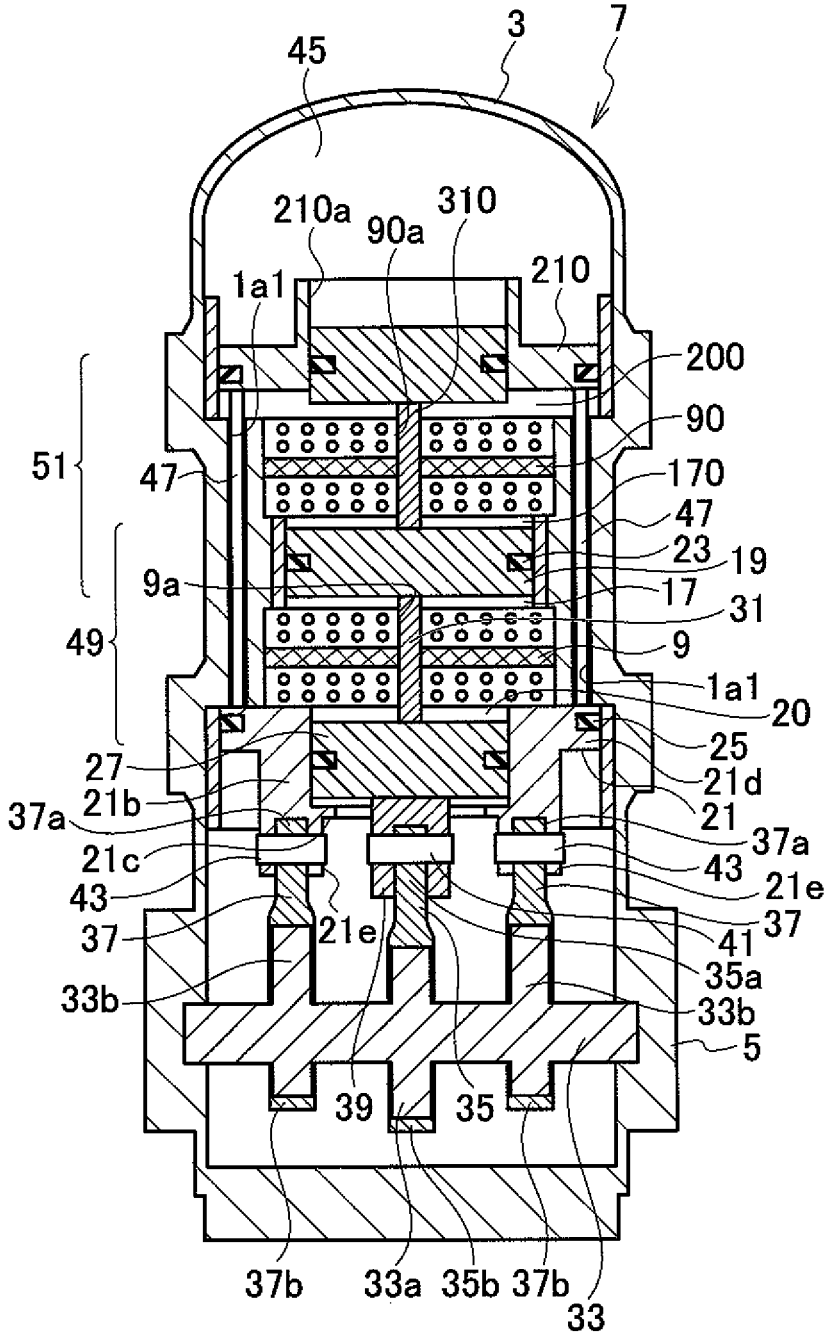
FIG. 6 is a cross-sectional view along a line C-C of FIG. 5.

In the third embodiment as shown in FIGS. 5 and 6, with respect to the constitution in FIG. 1 or FIG. 3, a second heat-exchanger unit 90 is provided at an opposite side to the heat-exchanger unit 9, positioning the first displacer 19 therebetween. In addition, a second power piston 210 and a third displacer 270 are provided at an opposite side to the first displacer 19 positioning the second heat-exchanger unit 90 therebetween.

The second power piston 210 includes a cylinder portion 210*a* corresponding to the cylinder portion 21*a* of the power piston 21. The third displacer 270 is housed reciprocally and slidably in a vertical direction in the cylinder portion 210*a*, and the third displacer 270 and the first displacer 19 are connected to each other with a second connecting rod 310. Therefore, the first displacer 19, the second displacer 27 and the third displacer 270 reciprocally travel together as a single unit.

In this embodiment, the power piston 21 has the outside diameter larger than that of the first displacer 19 as is the power piston 21A in the second embodiment. In addition, the second power piston 210 has the same outside diameter as that of the power piston 21.

The diameters of the power piston 21 and the second power piston 210 are larger than the diameter of the first displacer 19 as described above, and also longer than a length of one side of the heat-exchanger unit 9 or 90 having a substantial square shape in a plan view. Moreover, peripheral edges of each power piston 21 and 210 are protruded more than peripheral edges of the first displacer 19 and the heat-exchanger units 9 and 90.

Such outwardly protruded portions of the respective power pistons 21 and 210 are connected to each other with a plurality of, for example four, power piston connecting rods 47. Therefore, the power pistons 21 and 210 reciprocally travel together as a single unit. The above-mentioned four power piston connecting rods 47 are slidably inserted in housing through holes 1*a*1 formed by penetrating the heat-exchanger housing portion 1*a* of the housing main body 1 in a vertical direction.

Accordingly, in the present embodiment, one heat-engine unit 49 including the first and second displacers 19 and 27 and the power piston 21, and another heat-engine unit 51 including the first and third displacers 19 and 270 and the second power piston 210 are stacked in a piston-sliding direction. In this case, the heat-engine units 49 and 51 share the first displacer 19 that is positioned between the heat-engine units 49 and 51 adjacent to each other.

When the Stirling Cycle is used as an engine cycle while the heat-engine units 49 and 51 adjacent to each other share the piston (the first displacer 19) as described above to achieve simplification of a constitution, necessary output can be obtained with ease by stacking standardized modules as appropriate. Furthermore, a combined cycle can be substantiated in accordance with various heat sources and with various output temperatures by combining a heat pump cycle or a refrigerating cycle as appropriate.

Note that, the two heat-engine units 49 and 51 are employed in the example shown in FIG. 5. Meanwhile, the number of heat-engine units may be further increased to three, four, and so on.

In the example shown in FIG. 5, the second power piston 210 may reciprocally travel by separately providing two connecting rods and a crankshaft, as is the power piston 21, instead of connecting the power piston 21 and the second power piston 210 with the power piston connecting rods 47. In such a case, obviously the power pistons 21 and 210 move with a 180° phase difference from each other.

Fourth Embodiment

Figure 7:
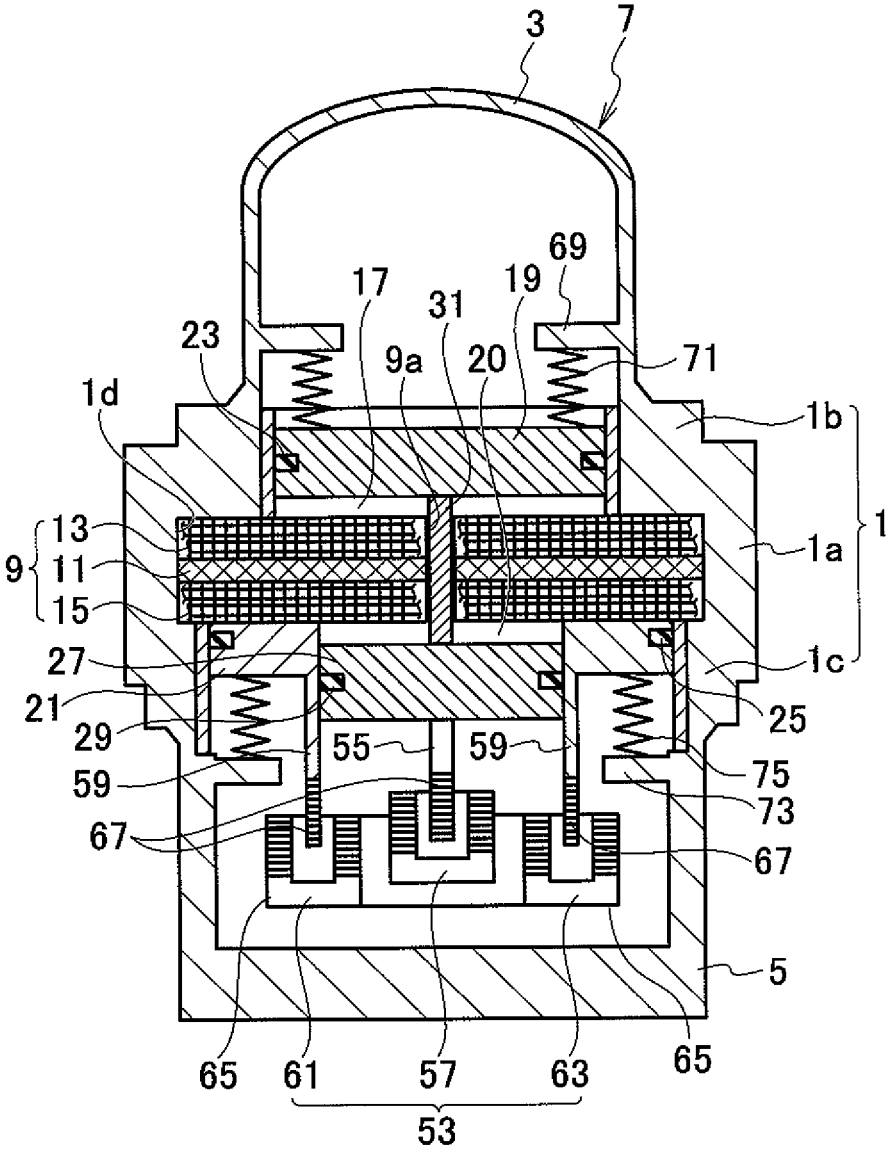
FIG. 7 is a cross-sectional view corresponding to FIG. 2 with regard to a heat engine according to a fourth embodiment of the present invention.

In the fourth embodiment as shown in FIG. 7, a linear generator unit (may be a linear motor) 53 is employed instead of the crankshaft 33 used in the above-described respective embodiments. The linear generator unit 53 includes a linear generator 57 for a single connecting rod 55 connected to the second displacer 27, and linear generators 61 and 63 for two connecting rods 59 connected to the power piston 21.

The respective linear generators 57, 61 and 63 have the similar constitutions, each of which includes a stator 65 having a coil fixed to the crankcase 5, and a plunger 67 as a mobile object that is slidable in a vertical direction in the stator 65 in FIG. 7. The plungers 67 are integrally provided to the respective connecting rods 55 and 59.

In addition, springs 71 are provided between the first displacer 19 and a spring receptor 69 that is formed inside the cover 3, and springs 75 are provided between the power piston 21 and a spring receptor 73 that is formed inside the crankcase 5, respectively. The springs 71 and 75 function to keep the first displacer 19 and the power piston 21 in a neutral position (a middle position of a piston traveling stroke), respectively.

In this case, the power piston 21 and the first and second displacers 19 and 27 reciprocally travel according to pressure changes of the working gases, whereby each plunger 67 reciprocally travels in each stator 65 so that the linear generators 57, 61 and 63 generate power. Then, the springs 71 and 75 are forcibly oscillated, so as to complement the reciprocating movements of the power piston 21 and the first and second displacers 19 and 27. In order that the first and second displacers 19 and 27 and the power piston 21 move with a phase difference smaller than 180°, such as a 90° phase difference, as is each embodiment described above, each mass of the first and second displacers 19 and 27 and the power piston 21, and each constant of spring of the springs 71 and 75 are controlled.

Alternatively, when the linear generator unit 53 is used as a linear motor, the linear generators 57, 61 and 63 function as a linear motor. Thus, current is supplied to the linear motor from an AC power supply, whereby the first and second displacers 19 and 27 and the power piston 21 are made to move reciprocally. As a result, the present embodiment functions as a heat pump or a refrigerator, which supplies a high-temperature heat or a low-temperature heat to the outside via heat transfer fluid that flows in the heat transfer pipes 13*a* or 15*a* penetrating the heat sink 13 or the radiator 15.

Though the present invention has been described by the embodiments thus far, the present invention is not limited to these embodiments, and changes and variations can be applicable.

What is claimed is:

1. A heat engine comprising:

a high-temperature space portion and a low-temperature space portion, each of which has a working gas with a different temperature range from each other;

a regenerator provided between the high-temperature space portion and the low-temperature space portion;

a first piston including a cylinder portion integrally formed inside the first piston, the first piston configured to cause volumetric changes of the working gases in each of the high-temperature space portion and the low-temperature space portion and transmit motive energy on receipt of pressure changes of the working gases; and a second piston and a third piston provided in the low-temperature space portion and the high-temperature space portion, respectively, the second piston and the third piston configured to transfer the working gases between the high-temperature space portion and the low-temperature space portion and move with a 180° phase difference from each other with respect to the regenerator, wherein the second piston is slidably housed in the cylinder portion of the first piston, the first piston, and the second piston and the third piston are configured to move with a phase difference smaller than 180°, heat and motive energy are exchanged by using the volumetric changes in the high-temperature space portion and the low-temperature space portion located respectively on both sides of the regenerator, as well as by using the transfer of the working gases, and the second piston and the third piston are connected to each other with a connecting rod.

2. The heat engine according to claim 1, wherein the second piston and the third piston are connected to each other in each center portion with a single connecting rod.

3. The heat engine according to claim 1, wherein a diameter of the first piston is larger than a diameter of the third piston.

4. The heat engine according to claim 1, wherein heat engine units, each of which includes the first to third pistons, are stacked in a moving direction of the first to third pistons; and one piston between the heat engine units stacked and located adjacent to each other is shared by each of the heat engine units as the third piston.

* * * * *